US007878264B2

(12) United States Patent
Koch et al.

(10) Patent No.: US 7,878,264 B2
(45) Date of Patent: Feb. 1, 2011

(54) HAND-HELD POWER TOOL

(75) Inventors: Olaf Koch, Kaufering (DE); Alexander Buchenau, Puergen (DE); Vera Nuebel, Munich (DE); Uto Plank, Freising (DE); Stefan Hammerstingl, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 313 days.

(21) Appl. No.: 12/220,642

(22) Filed: Jul. 24, 2008

(65) Prior Publication Data

US 2009/0032276 A1 Feb. 5, 2009

(30) Foreign Application Priority Data

Jul. 27, 2007 (DE) ..... 10 2007 000 408

(51) Int. Cl.
*B25F 5/02* (2006.01)

(52) U.S. Cl. ..... 173/162.2; 173/170; 173/211

(58) Field of Classification Search ..... 173/162.2, 173/162.1, 170, 211, 210
See application file for complete search history.

(56) References Cited

U.S. PATENT DOCUMENTS 1,596,252 A * 8/1926 Hansen ..... 403/376
2,062,817 A * 12/1936 Noble ..... 173/162.1
2,101,869 A * 12/1937 Noble ..... 267/137
2,531,800 A * 11/1950 Anderson ..... 173/162.2
2,831,463 A * 4/1958 Ekstrom et al. ..... 173/162.2
3,824,417 A * 7/1974 Moores, Jr. ..... 310/51
3,934,657 A * 1/1976 Danielson ..... 173/169
4,416,166 A * 11/1983 Jannard et al. ..... 74/551.9
4,611,671 A * 9/1986 Hansson ..... 173/162.2
4,643,263 A * 2/1987 Karden ..... 173/168
4,667,749 A * 5/1987 Keller ..... 173/162.2
5,125,286 A * 6/1992 Wilson ..... 74/551.9
5,273,120 A * 12/1993 Chang ..... 173/162.2
5,697,456 A * 12/1997 Radle et al. ..... 173/162.2
5,749,421 A * 5/1998 Johansson et al. ..... 173/162.2
5,934,154 A * 8/1999 Noel ..... 74/551.9
5,992,540 A * 11/1999 Smolinski et al. ..... 173/169
6,123,158 A * 9/2000 Steffen ..... 173/217
6,155,354 A * 12/2000 Pusateri et al. ..... 173/170

* cited by examiner

*Primary Examiner*—Scott A. Smith
(74) *Attorney, Agent, or Firm*—Abelman, Frayne & Schwab

(57) ABSTRACT

A hand-held power tool includes two vibration-damped handles (21), two handle attachment axles (31) for securing the two handles (21) on the tool outer housing (12), respectively, and extending at an angle to respective longitudinal axes (23) of respective handles (21), each handle attachment axle being surrounded, at least in some areas, by the mounting section (24) of the respective handle (21), a damping sleeve (31) formed of an elastic material and provided between the mounting section (24) of the respective handle (21) and the respective handle attachment axle (30), with the damping sleeve (31) forming a first damping element, and a damping body (36) provided on a free end (26) of each handle (21) and forming a second damping element and having an extension (D) in a radial, with respect to the handle longitudinal axis, direction that is greater than a minimal radial extension (T) of the handle (21) at its free, second end.

5 Claims, 2 Drawing Sheets

HAND-HELD POWER TOOL

BACKGROUND OF THE INVENTION

1. Field of the Invention

The present invention relates to a hand-held power tool including an outer hosing, a percussion mechanism, a motor for driving the percussion mechanism, two vibration-damped handles each having a support member, a longitudinal axis, and a mounting section provided at a first end region of the handle, two handle attachment axles for securing the two handles on the outer housing, respectively, and extending at an angle to respective longitudinal axes of respective handles, with each handle attachment axle being surrounded, at least in some areas, by the mounting section of a respective handle, and a damping sleeve formed of an elastic material and provided between the mounting section of the respective handle and the respective handle attachment axle, with the damping sleeve forming a first damping element.

2. Description of the Prior Art

Large hand-held power tools with a percussion mechanism such as, e.g., heaving electrically or pneumatically driven chisel hammers and breakers are often haphazardly dropped and impact the bottom, e.g., of a constructional component. The energy produced by the impact should be completely absorbed, if necessary, by the handles. This leads, at high falling forces or with a lasting use of the power tool, to damages and breaking of individual components of the power tool. In order to protect the power tool user against vibrations generated during operation of a hand-held power tool, it is known to form vibration-damped handles.

U.S. Pat. No. 3,824,417 A discloses a hand-held power tool having an outer housing, a percussion mechanism, an electrical drive for driving the percussion mechanism, and two vibration-damped handles. The handles are vibration-damped in a first plane and are dampingly supported against impacts in a second plane extending perpendicular to the first plane. Each handle has a support member, a longitudinal axis, and two mounting sections at its first end. The power tool further includes two handle attachment axles for attaching respective handles to the housing. The handle attachment axles extend parallel to each other and transverse to respective longitudinal axes of the handles. The axles are surrounded by the mounting sections of the respective handles. Between the handle attachment axles and the sleeve-shaped mounting sections, there are provided, respectively, sleeve-shaped damping elements formed of an elastic material.

The drawback of the power tool of U.S. Pat. No. 3,824,417 A consists in that the energy, which acts on the power tool upon the tool falling over, can be removed only through the support point of the handle. In order to ensure satisfactory guidance during an operation, particularly with the heavy power tools, the handle support should have sufficient stability. With large forces, the sleeve-shaped damping element is not enough for satisfactory removal or conversion of the generated energy which can result in damage to individual components.

Accordingly, an object of the present invention is a hand-held power tool with vibration-damped handles and which is a highly resistant to damages caused by the hand-held power tool falling over.

SUMMARY OF THE INVENTION

This and other objects of the present invention, which will become apparent hereinafter, are achieved by providing, according to the invention, at a second, free end of the handle, opposite the handle first end, a damping body which forms a second damping element and has, in a radial, with respect to the handle longitudinal axis, direction, an extension greater than a minimal radial extension of the handle at the handle free end.

When the power tool falls down on the handle, a large portion of the impact energy is absorbed by the damping body. The radial circumferential section of the damping body becomes deformed on impact due to the larger radial extent of the damping body in comparison with the radial extent of the handle. Thereby the damping body eliminates from 60% to 80% of the impact energy. The damping sleeve, which is located between the handle mounting section and the handle attachment axle, annihilates the largest portion of the still remaining impact energy acting on the power tool. With the multistage damping arrangement which is provided by the first and the second damping elements, the individual components of the power tool are subjected, upon the power tool falling down, to noticeably smaller forces than is the case with a conventional hand-held power tool with usually only vibration-damped handle. Advantageously, the damping body is formed of an elastomeric material. The damping body can also be formed as a buffer element with an attachment element and be formed, e.g., of a metal part. The fastening element connects the buffer element to the support member.

The support member of the handle itself should not provide for compensation of high impact forces, which noticeably extends their service life and noticeably reduces manufacturing costs of the handle.

Advantageously, the radial extension of the damping body corresponds to about 1.05 times the 1.8 times, particularly advantageously to about from 1.2 to 1.5 times of the radial extension of the handle at its free, second end. This ensures that the damping body has a sufficiently large, radial and circumferential, easily deformable bead-shaped section.

Preferably, there is provided a grip sleeve formed of an elastic material and surrounding, at least in some areas, the support member which is formed of metal, with the grip sleeve forming a third damping element and surrounding, at least in some areas, a free end of the support member of the handle, and with the damping body adjoining the grip sleeve.

Advantageously, the grip sleeve is formed of nitrilebutyl rubber (NBR). Alternatively, natural rubber (NR) or polyamide (PA) can be used for forming the grip sleeve. Upon the power tool falling down, a portion of the remaining, still available impact energy is absorbed by the support member of the handle and a portion of the grip sleeve between the damping body at the free end of the handle and the free end of the support member. Thereby, the damping arrangement is provided with a further stage that further reduces the impact energy which is absorbed in the interior of the power tool.

Advantageously, the grip sleeve is formed of two materials, with a material adjacent to the support member having a smaller elasticity than a material remote from the support member. E.g., if the material adjacent to the support member is a hard plastic material ensuring the stability of the grip sleeve, and the material remote from the support member is of soft plastic material, an adequate grip is ensured. The materials are chosen of such quality that they can deform under load and thereby once again annihilate a portion of the impact energy.

Advantageously, each handle is supported for a pivotal movement about a pivot axis defined by a respective handle attachment axle, and the hand-held power tool is further provided with a stop member for limiting pivotal movement of the handle. The stop member is formed of an elastic material. The stop member forms a fourth damping element. Advantageously, the stop member is formed of nitrilebutyl rubber (NBR). The damping sleeve, which is provided between the pivot axis and the mounting section of the handle, forms a first damping element. The stop member forms a further damping element for eliminating impact forces, ensuring an advantageous fall protection of the power tool. The pivotal movement provides for effective vibration damping. Simultaneously, the damping sleeve can absorb the increased impact energy.

Advantageously, each handle has a radially projecting collar, and an insert formed of an elastic material is provided between the outer housing and the collar and forms a fifth damping element. Advantageously, the insert is formed of nitrilebutyl rubber (NBR). The insert additionally improves the damping characteristics of the multistage damping arrangement.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show.

In the drawings, the same parts are designated basically with the same reference numerals.

DETAILED DESCRIPTION OF THE PREFERRED EMBODIMENT

Figure 1:
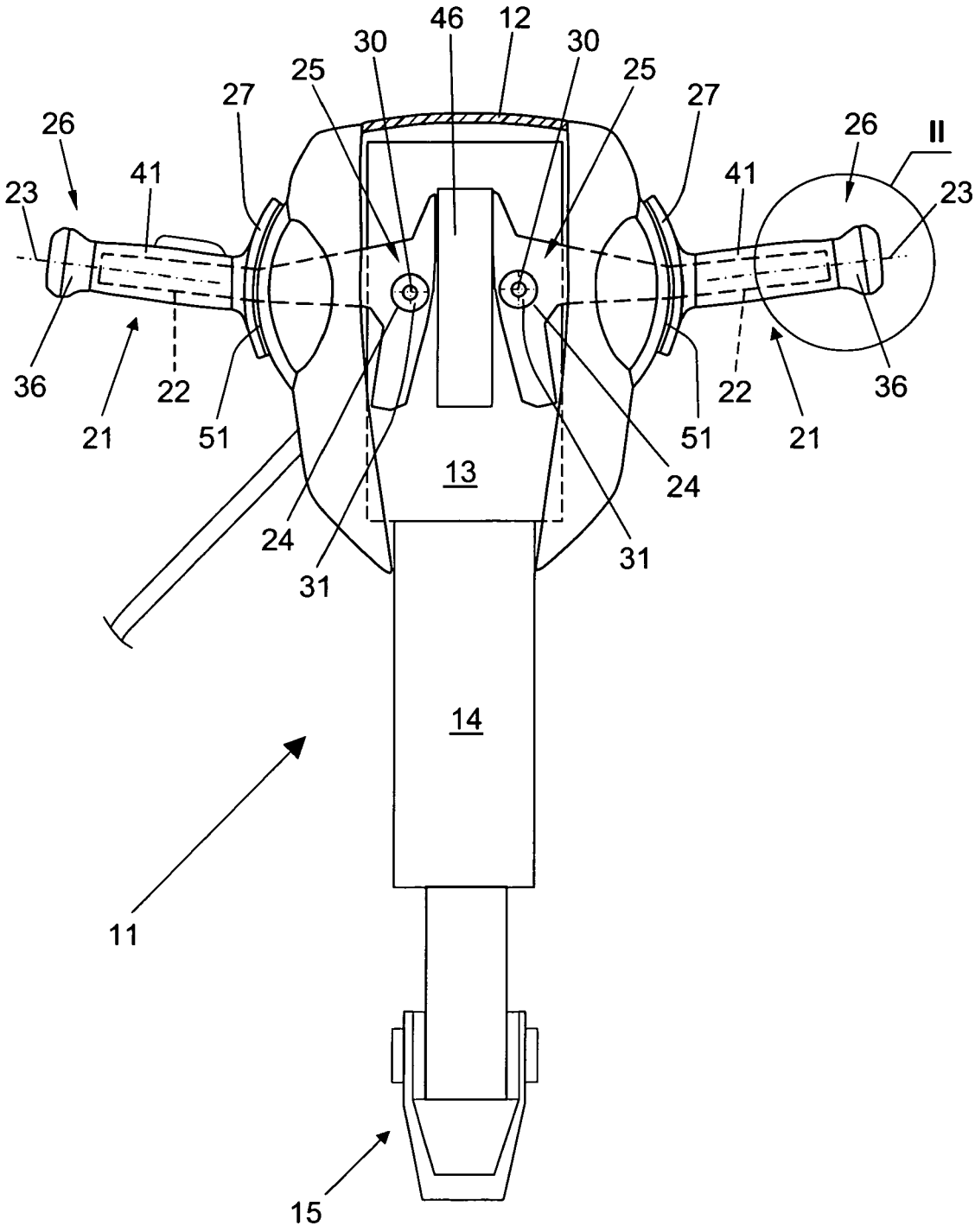
FIG. 1 a front elevational view of a hand-held power tool according to the present invention with a partial cut-out.
Figure 2:
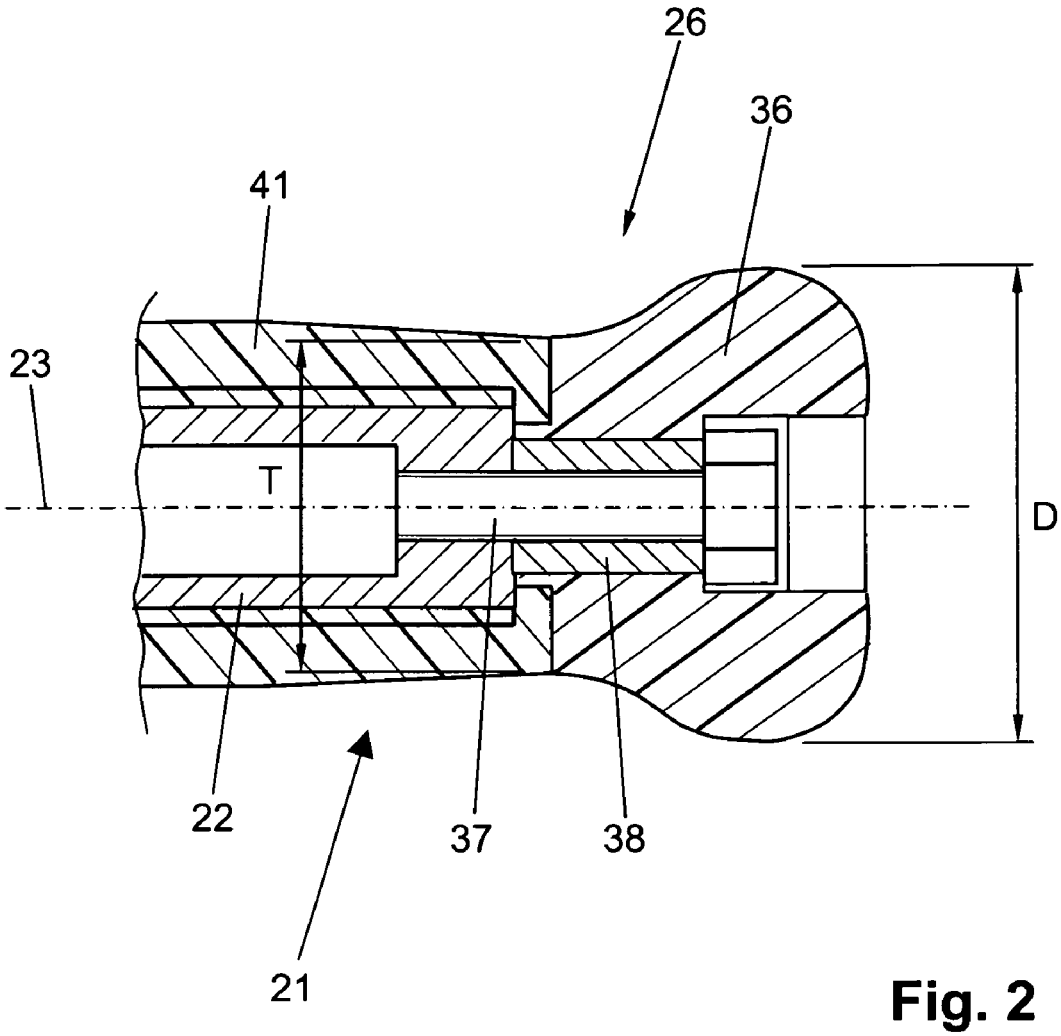
FIG. 2 a cross-sectional view of a detail II of a handle of the power tool shown in FIG. 1.

A hand-held power tool 11, which is formed as a heavy chisel hammer and is shown in FIGS. 1-2, has an outer housing 12, a drive 13, a percussion mechanism 14, and two vibration-damped handles 21. The drive 13 includes, e.g., a motor and a gear unit for driving the percussion mechanism 14. At the free end of the percussion mechanism 14, there is provided a tool holder 15 for a working tool, not shown.

Each handle 21 has a support member 22 which is formed of steel, a longitudinal axis 23, and a mounting section 24 provided in the first end region 25 of the handle 21. In the hand-held power tool 11, there are provided two handle attachment axles 30 which extend transverse to the longitudinal axes of respective handles 21, parallel to each other, and are surrounded by respective mounting sections 24 of the respective handles 21. The handles 21 are supported for pivotal movement about respective pivot axes which are defined by respective handle attachment axles 30. Between the mounting section 24 of the handle 21 and the handle attachment axle 30, there is provided a damping sleeve 31 formed of an elastic material. The damping sleeve 31 forms a first damping element. In the hand-held power tool 11, there is further provided a stop member 46 for limiting pivotal movement of the handle 21 and likewise formed of an elastic material. The stop member 46 forms a fourth damping element. The handles 21 are provided with a profile at their respective end regions 25 which are adapted to abut the stop member 46.

At a free end 26 of the handle 21, which is opposite the first end 25 of the handle 21, there is provided a damping body 36 that forms a second damping element. With reference to the longitudinal axis 23 of the handle 21, the second damping element has, in a radial direction, an extension D that is greater than the radial extension T of the handle 21 at its free end 26. The radial extension D of the damping body 36 corresponds approximately to from 1.2 times to 1.5 times of the minimal radial extension T of the handle 21 for forming a circumferential knob.

The support member 22 of the handle 21 is surrounded in some areas by a grip sleeve 41 that is also formed of an elastic material and forms a third damping element. The grip sleeve 41 surrounds in some areas the free end of the support member 22, and the damping body 36 adjoins the grip sleeve 41. The grip sleeve 41 is formed of two materials, with the material adjacent to the support member 22 having a smaller elasticity than the material remote from the support member 22. The damping body 36 is secured with a fastening element 37, e.g., in form of a screw engaging in the support member 22. Advantageously, the fastening element 37 has at its end a widening, e.g., a screw head at a shaft end. For an advantageous introduction of a portion of impact energy in the support member 22, a steel sleeve 38 is provided between the widening of the fastening element 37 and the free end of the support member 22.

Further, between a radially projected collar section 27 of the handle 21 and the outer housing 12, there is provided an insertion member 51 that is formed of an elastic material and forms a fifth damping element.

Separate damping elements form together a multi-stage damping arrangement for the hand-held power tool 11 and which provides a high accident protection and, thereby, a high protection against damages of the hand-held power tool 11. Furthermore, the damping arrangement ensures an advantageous damping of vibrations which are generated by the hand-held power tool.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power tool, comprising an outer housing (12); a percussion mechanism (14); a motor (13) for driving the percussion mechanism (14); two vibration-damped handles (21) each having a support member (22), a longitudinal axis (23), and a mounting section (24) provided at a first end region of the handle (21); two handle attachment axles (30) for securing the two handles (21) on the outer housing (12), respectively, and extending at an angle to respective longitudinal axes (23) of respective handles (21), each handle attachment axle (30) being surrounded, at least in some areas, by the mounting section (24) of the respective handle (21); a damping sleeve (31) formed of an elastic material and provided between the mounting section (24) of the respective handle (21) and the respective handle attachment axle (30), the damping sleeve (31) forming a first damping element; a damping body (36) provided at a second free end (26) of each handle (21) opposite the handle first end (25), the damping body (36) forming a second damping element and having an extension (D) in a radial, with respect to the handle longitudinal axis, direction that is greater than a minimal radial extension (T) of the handle (21) at the free, second end thereof; and a grip sleeve (41) formed of an elastic material and surrounding, at least in some areas, a free end of the support member (22) of each handle (21), the grip sleeve (41) forming a third damping element, the damping body (36) adjoining the grip sleeve (41), wherein each handle (21) is supported for a pivotal movement about a pivot axis defined by a respective handle attachment axle (30), the hand-held power tool further comprising a stop member (46) for limiting pivotal movement of the handle (21) and formed of an elastic material, the stop member (46) forming a fourth damping element, and wherein each handle (21) has a radially projecting collar (27), and an insert (51) formed of an elastic material and provided between the outer housing (12) and a respective collar (27), the insert forming a fifth damping element.

2. A hand-held power tool according to claim 1, wherein the radial extension (D) of the damping body (36) corresponds to about 1.05 times to 1.8 times of the radial extension (T) of the handle at the free, second end (26) thereof.

3. A hand-held power tool according to claim 1, wherein the grip sleeve (41) is formed of two materials, and wherein a material adjacent to the support member (22) has a smaller elasticity than a material remote from the support member (22).

4. A hand-held power tool, comprising an outer housing (12); a percussion mechanism (14); a motor (13) for driving the percussion mechanism (14); two vibration-damped handles (21) each having a support member (22), a longitudinal axis (23), and a mounting section (24) provided at a first end region of the handle (21); two handle attachment axles (30) for securing the two handles (21) on the outer housing (12), respectively, and extending at an angle to respective longitudinal axes (23) of respective handles (21), each handle attachment axle (30) being surrounded, at least in some areas, by the mounting section (24) of the respective handle (21); a damping sleeve (31) formed of an elastic material and provided between the mounting section (24) of the respective handle (21) and the respective handle attachment axle (30), the damping sleeve (31) forming a first damping element; and a damping body (36) provided at a second free end (26) of each handle (21) opposite the handle first end (25), the damping body (36) forming a second damping element and having an extension (D) in a radial, with respect to the handle longitudinal axis, direction that is greater than a minimal radial extension (T) of the handle (21) at the free, second end thereof, wherein each handle (21) has a radially projecting collar (27), and an insert (51) formed of an elastic material is provided between the outer housing (12) and a respective collar (27), the insert (51) forming a further damping element.

5. A hand-held power tool according to claim 4, wherein each handle (21) is supported for a pivotal movement about a pivot axis defined by a respective handle attachment axle (30), the hand-held power tool further comprising a stop member (46) for limiting pivotal movement of the handle (21) and formed of an elastic material, the stop member (46) forming a still further damping element.

* * * * *